US010718551B2

(12) United States Patent
Edwards et al.

(10) Patent No.: US 10,718,551 B2
(45) Date of Patent: Jul. 21, 2020

(54) HYBRID VAPOR COMPRESSION/THERMOELECTRIC HEAT TRANSPORT SYSTEM

(71) Applicant: Phononic, Inc., Durham, NC (US)

(72) Inventors: Jesse W. Edwards, Wake Forest, NC (US); Robert B. Allen, Winston-Salem, NC (US); Devon Newman, Morrisville, NC (US)

(73) Assignee: Phononic, Inc., Durham, NC (US)

( * ) Notice: Subject to any disclaimer, the term of this patent is extended or adjusted under 35 U.S.C. 154(b) by 214 days.

(21) Appl. No.: 15/293,622

(22) Filed: Oct. 14, 2016

(65) Prior Publication Data

US 2017/0108254 A1 Apr. 20, 2017

Related U.S. Application Data

(60) Provisional application No. 62/242,019, filed on Oct. 15, 2015.

(51) Int. Cl.
*F25B 21/02* (2006.01)
*F25B 21/04* (2006.01)

(52) U.S. Cl.
CPC ..... *F25B 21/04* (2013.01); *F25B 21/02* (2013.01); *F25B 2321/021* (2013.01); *F25B 2321/0252* (2013.01)

(58) Field of Classification Search
CPC ..... F25B 21/02; F25B 21/04; F25B 2321/021
See application file for complete search history.

(56) References Cited

U.S. PATENT DOCUMENTS 5,361,587 A * 11/1994 Hoffman ..... B01D 5/0042 62/3.2
5,497,625 A * 3/1996 Manz ..... F25B 21/04 62/149

(Continued)

FOREIGN PATENT DOCUMENTS

JP S611967 A 1/1986
JP H01306783 A 12/1989

(Continued)

OTHER PUBLICATIONS

International Preliminary Report on Patentability for International Patent Application No. PCT/US2016/056990, dated Jan. 18, 2018, 7 pages.

(Continued)

*Primary Examiner* — David J Teitelbaum
(74) *Attorney, Agent, or Firm* — Withrow & Terranova, PLLC

(57) ABSTRACT

A hybrid Vapor Compression (VC) and Thermoelectric (TE) heat transport system is provided that maintains a set point temperature range of a chamber and includes a VC system and a TE system. The VC system includes a compressor, a condenser-evaporator connected to the compressor, a first valve connecting the compressor to an evaporator-condenser, and a second valve connecting the evaporator-condenser to a thermal expansion valve. The TE system includes TE modules, a first heat exchanger thermally connected with a first side of the TE modules which connects the first valve and the second valve, and a second heat exchanger thermally connected with a second side of the TE modules which connects the first valve and the second valve. In this way, the VC system and the TE system can be operated individually, in series, or in parallel to increase the efficiency of the hybrid VC and TE heat transport system.

3 Claims, 5 Drawing Sheets

(56) References Cited

U.S. PATENT DOCUMENTS

| | | | | |
|---|---|---|---|---|
| 2007/0101748 | A1 | 5/2007 | Pham et al. | |
| 2009/0100842 | A1 | 4/2009 | Tsai et al. | |
| 2010/0287952 | A1* | 11/2010 | Goenka ..... | B60H 1/00478 62/3.1 |
| 2012/0102991 | A1 | 5/2012 | Lee et al. | |
| 2014/0116072 | A1 | 5/2014 | Kim et al. | |
| 2014/0260332 | A1 | 9/2014 | Wu | |

FOREIGN PATENT DOCUMENTS

| | | | |
|---|---|---|---|
| JP | H04126974 | A | 4/1992 |
| JP | H0547763 | U | 6/1993 |
| JP | 2002364980 | A | 12/2002 |
| JP | 2017146285 | A | 8/2017 |
| WO | 9911986 | A1 | 3/1999 |
| WO | 2013061473 | A1 | 5/2013 |

OTHER PUBLICATIONS

International Search Report and Written Opinion for International Patent Application No. PCT/US2016/056990, dated Feb. 7, 2017, 12 pages.

Written Opinion for International Patent Application No. PCT/US2016/056990, dated Sep. 12, 2017, 6 pages.

Notice of Reasons for Rejection for Japanese Patent Application No. 2018-519370, dated Aug. 6, 2019, 18 pages.

First Office Action for Chinese Patent Application No. 201680059370.X, dated Nov. 20, 2019, 10 pages.

Decision to Grant for Japanese Patent Application No. 2018-519370, dated Nov. 19, 2019, 4 pages.

* cited by examiner

VC OPERATION:
EXTREME LOAD CONDITIONS

SOLID-STATE OPERATION:
LIGHT LOAD CONDITIONS

PARALLEL OPERATION:
INTERMEDIATE TO EXTREME CONDITIONS
(MAXIMUM CAPACITY)

SERIES OPERATION:
LIGHT TO INTERMEDIATE CONDITIONS

HYBRID VAPOR COMPRESSION/THERMOELECTRIC HEAT TRANSPORT SYSTEM

PRIORITY APPLICATION

The present application claims priority to U.S. Provisional Patent Application Ser. No. 62/242,019, filed on Oct. 15, 2016, which is incorporated herein by reference in its entirety.

FIELD OF DISCLOSURE

The present disclosure relates to heat removal systems, and particularly to a hybrid heat transfer system.

BACKGROUND

The demand for energy conservation has grown substantially due to concerns over limited resources and the environment. This has led to advances in energy efficient appliances. Heat transfer systems generally operate to transfer heat from an area of higher temperature to an area of lower temperature. In some cases, this can act as a refrigerator to remove heat from a chamber and deposit the heat in an environment external to the chamber. In other cases, a heat transfer system can be used to condition the air in a chamber such as a room or a house. In these cases, the heat transfer system may operate to remove heat from the chamber (cooling) or deposit heat in the chamber (heating).

The most common type of energy efficient heat transfer systems use vapor compression systems. In these systems, mechanical components consume energy to actively transport heat. These components may include a compressor, a condenser, a thermal expansion valve, an evaporator, and plumbing that circulates a working fluid (e.g., refrigerant). The components circulate the refrigerant, which undergoes forced phase changes to transport heat to/from a chamber from/to an external environment.

However, vapor compression systems are designed with a capacity that matches the maximum amount of heat transfer that may be needed. Therefore, in most situations, the vapor compression system is overpowered and must be cycled on and off (e.g., a duty cycle) to maintain the proper amount of heat transfer or to maintain a set point temperature range of a chamber. While the vapor compression system may be efficient when on, it may lead to heat leak back and other negative results when the vapor compression system is off. As such, systems and methods are needed for heat transfer that provides higher energy efficiency at lower costs while maintaining versatility of performance.

SUMMARY

A hybrid Vapor Compression (VC) and Thermoelectric (TE) heat transport system and methods of operation are provided herein. In some embodiments, a hybrid VC and TE heat transport system arranged to maintain a set point temperature range of a chamber includes a VC system and a TE system. The VC system includes a compressor with first and second ports, a condenser-evaporator connected to the compressor at the first port, a first valve connecting the second port of the compressor to an evaporator-condenser, and a second valve connecting the evaporator-condenser to a thermal expansion valve where the thermal expansion valve connects the second valve to the condenser-evaporator. The TE system includes one or more TE modules including a first side of the TE modules and a second side of the TE modules. The TE system also includes a first heat exchanger thermally connected with the first side of the TE modules where the first heat exchanger connects the first valve and the second valve, and a second heat exchanger thermally connected with the second side of the TE modules where the second heat exchanger connects the first valve and the second valve. In this way, the VC system and the TE system can be operated individually, in series, or in parallel to increase the efficiency of the hybrid VC and TE heat transport system.

In some embodiments, the first valve and second valve are operable so that the evaporator-condenser of the VC system is the first heat exchanger of the TE system or the second heat exchanger of the TE system. In some embodiments, the hybrid VC and TE heat transport system operates to heat the chamber. In some embodiments, the hybrid VC and TE heat transport system operates to cool the chamber.

In some embodiments, the hybrid VC and TE heat transport system also includes a controller arranged to operate the hybrid VC and TE heat transport system in one of several modes of operation based on one or more system parameters. In some embodiments, one of the modes of operation is a VC-only mode of operation and the controller is further arranged to, during the VC-only mode of operation, control the first valve to connect the second port of the compressor to the evaporator-condenser, control the second valve to connect the evaporator-condenser to the thermal expansion valve, activate the VC system, and refrain from activating the TE system.

In some embodiments, one of the modes of operation is a TE-only mode of operation and the controller is further arranged to, during the TE-only mode of operation, control the first valve to disconnect the second port of the compressor from the evaporator-condenser, control the second valve to disconnect the evaporator-condenser from the thermal expansion valve, activate the TE system, and refrain from activating the VC system.

In some embodiments, one of the modes of operation is a series mode of operation and the controller is further arranged to, during the series mode of operation, control the first valve to connect the second port of the compressor to the evaporator-condenser of the VC system where the evaporator-condenser is the first heat exchanger of the TE system, control the second valve to connect the evaporator-condenser to the thermal expansion valve, activate the TE system, and activate the VC system.

In some embodiments, one of the modes of operation is a parallel mode of operation and the controller is further arranged to, during the parallel mode of operation, control the first valve to connect the second port of the compressor to the evaporator-condenser of the VC system where the evaporator-condenser is the second heat exchanger of the TE system, control the second valve to connect the evaporator-condenser to the thermal expansion valve, activate the TE system, and activate the VC system.

In some embodiments, a method of operating a hybrid VC and TE heat transport system including a VC system and a TE system includes operating the hybrid VC and TE heat transport system to maintain a set point temperature range of a chamber. In some embodiments, operating the hybrid VC and TE heat transport system includes operating the hybrid VC and TE heat transport system to heat the chamber by operating one or both of the VC system and the TE system to provide heat to the chamber. In some embodiments, operating the hybrid VC and TE heat transport system includes operating the hybrid VC and TE heat transport system to cool the chamber by operating one or both of the VC system and the TE system to remove heat from the chamber.

In some embodiments, operating the hybrid VC and TE heat transport system also includes operating the hybrid VC and TE heat transport system in a VC-only mode of operation by controlling a first valve to connect a second port of a compressor to an evaporator-condenser, controlling a second valve to connect the evaporator-condenser to a thermal expansion valve, activating the VC system, and refraining from activating the TE system.

In some embodiments, operating the hybrid VC and TE heat transport system also includes operating the hybrid VC and TE heat transport system in a TE-only mode of operation by controlling the first valve to disconnect the second port of the compressor from the evaporator-condenser, controlling the second valve to disconnect the evaporator-condenser from the thermal expansion valve, activating the TE system, and refraining from activating the VC system.

In some embodiments, operating the hybrid VC and TE heat transport system also includes operating the hybrid VC and TE heat transport system in a series mode of operation by controlling the first valve to connect the second port of the compressor to the evaporator-condenser of the VC system where the evaporator-condenser is a first heat exchanger of the TE system, controlling the second valve to connect the evaporator-condenser to the thermal expansion valve, activating the TE system, and activating the VC system.

In some embodiments, operating the hybrid VC and TE heat transport system also includes operating the hybrid VC and TE heat transport system in a parallel mode of operation by controlling the first valve to connect the second port of the compressor to the evaporator-condenser of the VC system where the evaporator-condenser is a second heat exchanger of the TE system, controlling the second valve to connect the evaporator-condenser to the thermal expansion valve, activating the TE system, and activating the VC system.

In some embodiments, operating the hybrid VC and TE heat transport system also includes determining, based on one or more parameters, to operate the hybrid VC and TE heat transport system in the VC-only mode of operation, the TE-only mode of operation, the series mode of operation, or the parallel mode of operation. In some embodiments, determining to operate the hybrid VC and TE heat transport system in a mode of operation also includes determining to operate the hybrid VC and TE heat transport system in the mode of operation that maximizes a coefficient of performance of the hybrid VC and TE heat transport system based on the one or more parameters. In some embodiments, one of the parameters is a temperature difference between the chamber and an environment external to the hybrid VC and TE heat transport system.

In some embodiments, determining to operate the hybrid VC and TE heat transport system in the mode also includes determining a temperature of the chamber and determining whether to operate the hybrid VC and TE heat transport system to provide heat to the chamber or to remove heat from the chamber based on the temperature of the chamber and the set point temperature range of the chamber. The method also includes determining the temperature difference between the chamber and the environment external to the hybrid VC and TE heat transport system and determining to operate the hybrid VC and TE heat transport system in the mode of operation that maximizes the coefficient of performance of the hybrid VC and TE heat transport system based on the temperature difference between the chamber and the environment external to the hybrid VC and TE heat transport system.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
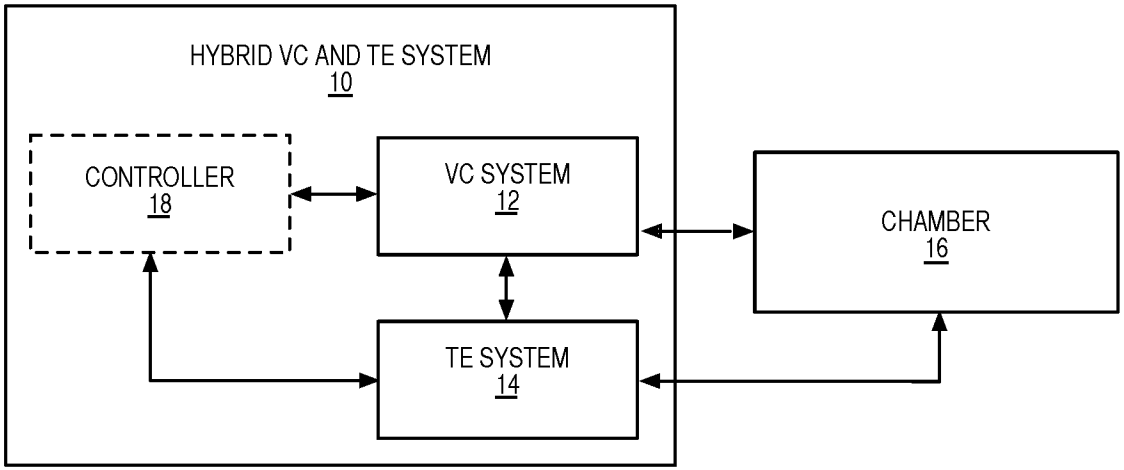
FIG. 1 illustrates a schematic of a hybrid Vapor Compression (VC) and Thermoelectric (TE) heat transport system, according to some embodiments of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It should be understood that, although the terms first, second, etc. may be used herein to describe various elements, these elements should not be limited by these terms. These terms are only used to distinguish between elements. For example, a first element could be termed a second element, and, similarly, a second element could be termed a first element, without departing from the scope of the present disclosure.

It should also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should also be understood that the singular forms "a," "an," and "the" include the plural forms, unless the context clearly indicates otherwise. The terms "comprises," "comprising," "includes," and/or "including," when used herein specify the presence of stated features, integers, steps, operations, elements, and/or components, but do not preclude the presence or addition of one or more other features, integers, steps, operations, elements, components, and/or groups thereof. Moreover, the term "and/or" includes any and all combinations of one or more of the associated listed items.

Unless otherwise defined, all terms (including technical and scientific terms) used herein have the same meaning as commonly understood by one of ordinary skill in the art to which this disclosure belongs. It will be further understood that terms used herein should be interpreted as having meanings that are consistent with their meanings in the context of this specification and the relevant art and will not be interpreted in an idealized or overly formal sense unless expressly so defined herein.

While Vapor Compression (VC) systems are more efficient than other heat transport systems in many scenarios, they are designed with a capacity that matches the maximum amount of heat transfer that may be needed. Therefore, in most situations, the VC system is overpowered and must be cycled on and off (e.g., a duty cycle) to maintain the proper amount of heat transfer or to maintain a set point temperature range of a chamber. While the VC system may be efficient when on, it may lead to heat leak back and other negative results when the VC system is off. As such, systems and methods are needed for heat transfer that provides higher energy efficiency at lower costs while maintaining versatility of performance.

A hybrid VC and Thermoelectric (TE) heat transport system and methods of operation are provided herein. In some embodiments, a hybrid VC and TE heat transport system arranged to maintain the set point temperature range of the chamber includes a VC system and a TE system. The VC system includes a compressor with first and second ports, a condenser-evaporator connected to the compressor at the first port, a first valve connecting the second port of the compressor to an evaporator-condenser, and a second valve connecting the evaporator-condenser to a thermal expansion valve where the thermal expansion valve connects the second valve to the condenser-evaporator. The TE system includes one or more TE modules including a first side of the TE modules and a second side of the TE modules. The TE system also includes a first heat exchanger thermally connected with the first side of the TE modules where the first heat exchanger connects the first valve and the second valve, and a second heat exchanger thermally connected with the second side of the TE modules where the second heat exchanger connects the first valve and the second valve. In this way, the VC system and the TE system can be operated individually, in series, or in parallel to increase the efficiency of the hybrid VC and TE heat transport system.

Combining both VC and TE technologies into a single, fully reversible system allows for utilization of the process portion or serial/parallel combination that is most efficient and/or effective for a given condition. This architecture allows both systems to, independently or together, provide maximum efficiency and performance, greater than that achievable by either system alone.

FIG. 1 illustrates a schematic of a hybrid VC and TE heat transport system 10, according to some embodiments of the present disclosure. The hybrid VC and TE heat transport system 10 includes a VC system 12 and a TE system 14 that operate to heat or cool the chamber 16. The hybrid VC and TE heat transport system 10 also optionally includes a controller 18 which can control one or both of the VC system 12 and the TE system 14.

The hybrid VC and TE heat transport system 10 can be operated in four basic modes (TE-only, VC-only, serial hybrid, and parallel hybrid) in either a cooling or heating configuration depending on the demand, loading and environmental conditions. In many of the examples discussed herein, the hybrid VC and TE heat transport system 10 is being used to cool the chamber 16, however, all of the examples apply equally to the reverse operation of heating the chamber 16.

Figure 2:
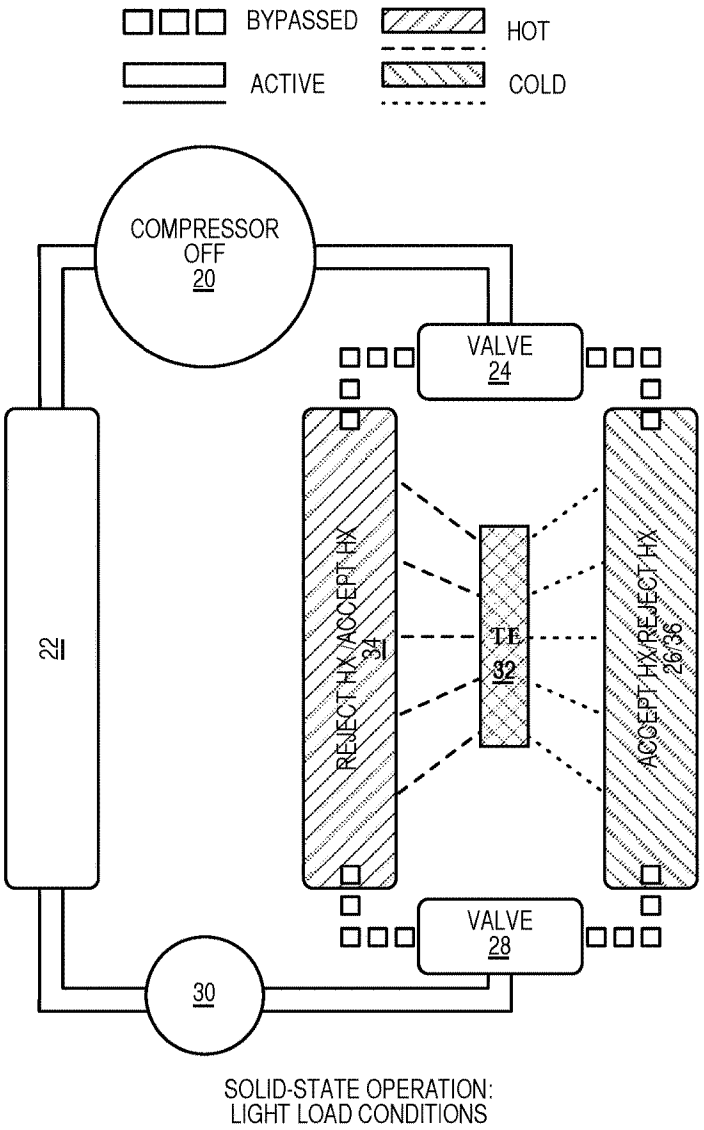
FIG. 2 illustrates a TE-only mode of operation of the hybrid VC and TE heat transport system, according to some embodiments of the present disclosure.

FIG. 2 illustrates a TE-only mode of operation of the hybrid VC and TE heat transport system 10, according to some embodiments of the present disclosure. The VC system 12 includes a compressor 20 with first and second ports, a condenser-evaporator 22 connected to the compressor 20 at the first port, a first valve 24 connecting the second port of the compressor 20 to an evaporator-condenser 26, and a second valve 28 connecting the evaporator-condenser 26 to a thermal expansion valve 30 where the thermal expansion valve 30 connects the second valve 28 to the condenser-evaporator 22. In operation, the components of the VC system 12 circulate the refrigerant, which undergoes forced phase changes to transport heat to/from the chamber 16 from/to an external environment.

As is shown in FIG. 2, both the first valve 24 and the second valve 28 are bypassed so that a working fluid (e.g., refrigerant) cannot flow through the first valve 24 and the second valve 28. As such, the VC system 12 is not activated. However, the TE system 14 is activated, hence the name TE-only mode of operation of the hybrid VC and TE heat transport system 10.

As is shown in FIG. 2, the TE system 14 includes one or more TE modules 32 including a first side of the TE modules 32 and a second side of the TE modules 32. The TE system 14 represents an environmentally friendly alternative to VC systems since it does not require CFC-based refrigerants. The TE modules 32 (also known as thermoelectric heat pumps which may include one or more individual modules which may further include one or more TE elements) produce a temperature difference across surfaces thereof in response to application of an electric current. Heat may be accepted from a surface or chamber to be cooled, and may be transported (e.g., via a series of transport pipes) to a reject heat sink for dissipation to an ambient medium such as air. TE systems may include passive heat reject subsystems such as thermosiphons or heat pipes that dispense with a need for forced transport of pressurized coolant though a reject heat sink. As with all refrigeration systems, the smaller the temperature difference across TE modules 32, the more efficient the heat pump will be at transporting heat. However, in some situations, such systems might be less than half as efficient as VC system 12.

As such, the TE system 14 of FIG. 2 also includes a first heat exchanger 34 thermally connected with the first side of the TE modules 32 and the first heat exchanger 34 connects the first valve 24 and the second valve 28. A second heat exchanger 36 thermally connects with the second side of the TE modules 32 and the second heat exchanger 36 also connects the first valve 24 and the second valve 28. The first valve 24 and the second valve 28 can be operated to adjust the fluid flow of the VC system 12. If the first valve 24 and the second valve 28 are fully closed or bypassed, then there will be no fluid flow in the VC system 12. This embodiment is shown in FIG. 2 where the VC system 12 is not activated, but the TE system 14 is. As discussed above, this is referred to as the TE-only mode of operation of the hybrid VC and TE heat transport system 10.

In the example of FIG. 2, the TE system 14 is operated to remove heat from the second heat exchanger 36, acting as an accept heat exchanger, and move the heat to the first heat exchanger 34, acting as a reject heat exchanger. In this configuration, the second heat exchanger 36 is cooled, which allows for cooling the chamber 16. The TE modules 32 could also be operated in reverse, to remove heat from the first heat exchanger 34, acting as an accept heat exchanger, and move the heat to the second heat exchanger 36, acting as a reject heat exchanger. In this configuration, the second heat exchanger 36 is heated which allows for heating the chamber 16.

Figure 3:
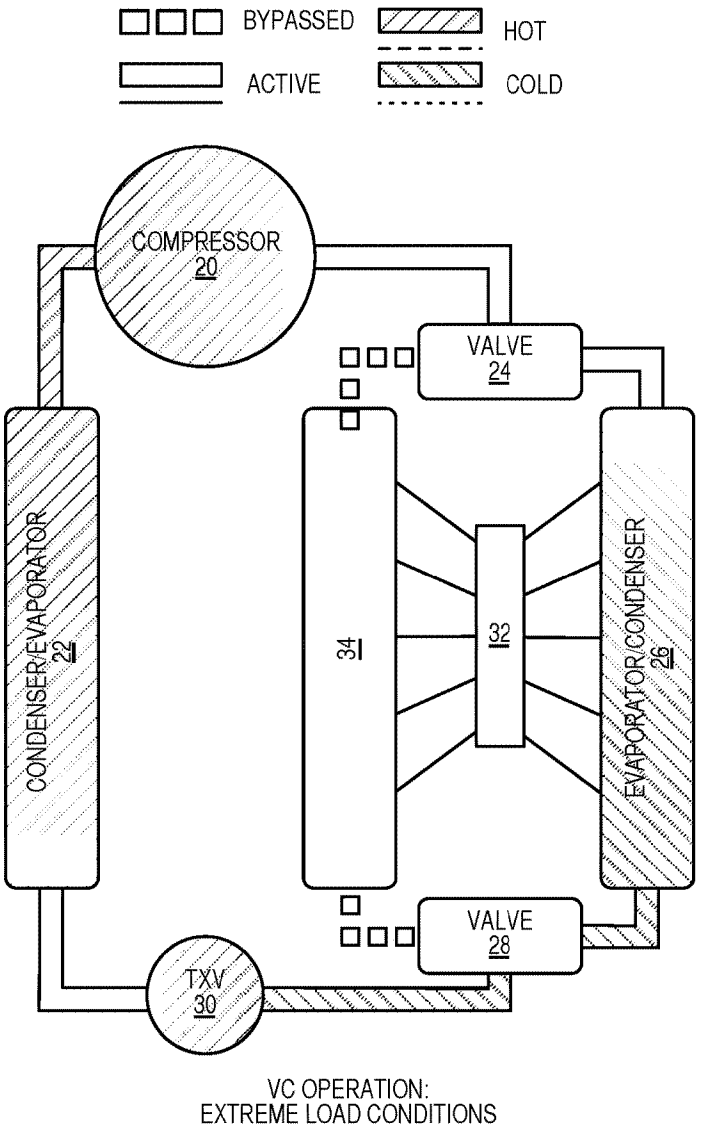
FIG. 3 illustrates a VC-only mode of operation of the hybrid VC and TE heat transport system, according to some embodiments of the present disclosure.

FIG. 3 illustrates a VC-only mode of operation of the hybrid VC and TE heat transport system 10, according to some embodiments of the present disclosure. In this embodiment, the first valve 24 is operated to connect the second port of the compressor 20 to the evaporator-condenser 26. The second valve 28 is operated to connect the evaporator-condenser 26 to the thermal expansion valve 30. This permits the fluid of the VC system 12 to flow through the evaporator-condenser 26. In this embodiment, the VC system 12 is activated, while the TE system 14 is not activated. As shown in FIG. 3, the condenser-evaporator 22 is dissipating heat, acting as a condenser, while the heat is being removed from the evaporator-condenser 26, acting as an evaporator. In this example, the evaporator-condenser 26 is cooled, which allows for cooling the chamber 16. As before with the TE system 14, the VC system 12 could also be operated in reverse, to remove heat from the condenser-evaporator 22, acting as an evaporator, and move the heat to the evaporator-condenser 26, acting as a condenser. In this configuration, the evaporator-condenser 26 is heated which allows for heating the chamber 16.

The two embodiments shown in FIGS. 2 and 3 allow for the same system to use either a VC or TE system to heat or cool a chamber 16. This may allow for changing between the two types of systems depending on various parameters that indicate which system would be more efficient, or meet some other goal such as reduced noise. While these modes of operation provide enhanced efficiency and other benefits, additional benefits may occur from operating both systems simultaneously. Based on the configuration of the first valve 24 and the second valve 28, this combination may be either series or parallel.

Figure 4:
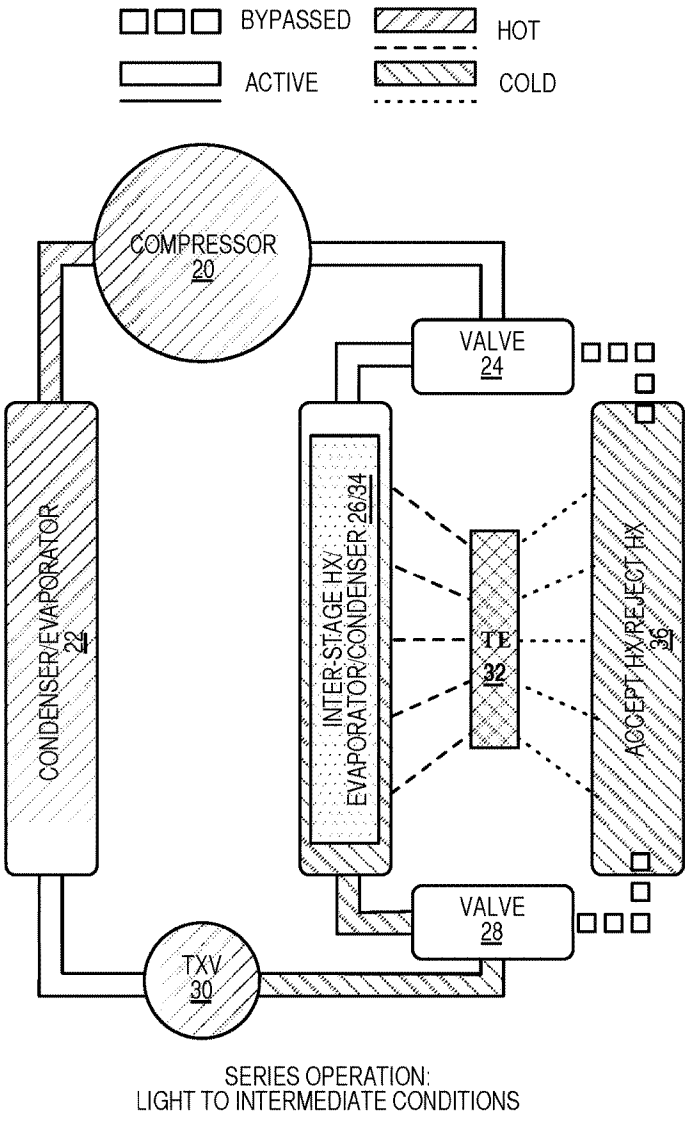
FIG. 4 illustrates a series mode of operation of the hybrid VC and TE heat transport system, according to some embodiments of the present disclosure.

FIG. 4 illustrates a series mode of operation of the hybrid VC and TE heat transport system 10, according to some embodiments of the present disclosure. In this embodiment, the first valve 24 is operated to connect the second port of the compressor 20 to the evaporator-condenser 26 of the VC system 12 where the evaporator-condenser 26 is the first heat exchanger 34 of the TE system 14. The second valve 28 is operated to connect the evaporator-condenser 26 to the thermal expansion valve 30. This permits the fluid of the VC system 12 to flow through the evaporator-condenser 26. In this embodiment, the VC system 12 is activated and the TE system 14 is activated.

As shown in FIG. 4, the condenser-evaporator 22 is dissipating heat, acting as a condenser, while the heat is being removed from the evaporator-condenser 26, acting as an evaporator. In this example, the evaporator-condenser 26 is cooled and also acts as the first heat exchanger 34 of the TE system 14. The activated TE modules 32 dissipate heat into the first heat exchanger 34 which is cooled by the VC system 12 and remove heat from the second heat exchanger 36, cooling it. In this way, a larger overall temperature gradient can be achieved than when either system is operated alone. For instance, if the VC system 12 provides a $\Delta T_{VC}$ temperature differential between the environment external to the hybrid VC and TE heat transport system 10 and the first heat exchanger 34, while the TE system 14 provides a $\Delta T_{TE}$ temperature differential between the first heat exchanger 34 and the second heat exchanger 36, the overall temperature differential is $\Delta T=\Delta T_{VC}+\Delta T_{TE}$. In some embodiments, this mode of operation can permit either one or both of the VC system 12 and the TE system 14 to be less powerful than either system would be required to be alone to achieve the same temperature differential.

As before with the embodiments discussed in FIGS. 2 and 3, each of the VC system 12 and the TE system 14 could also be operated in reverse, for heating the chamber 16.

Figure 5:
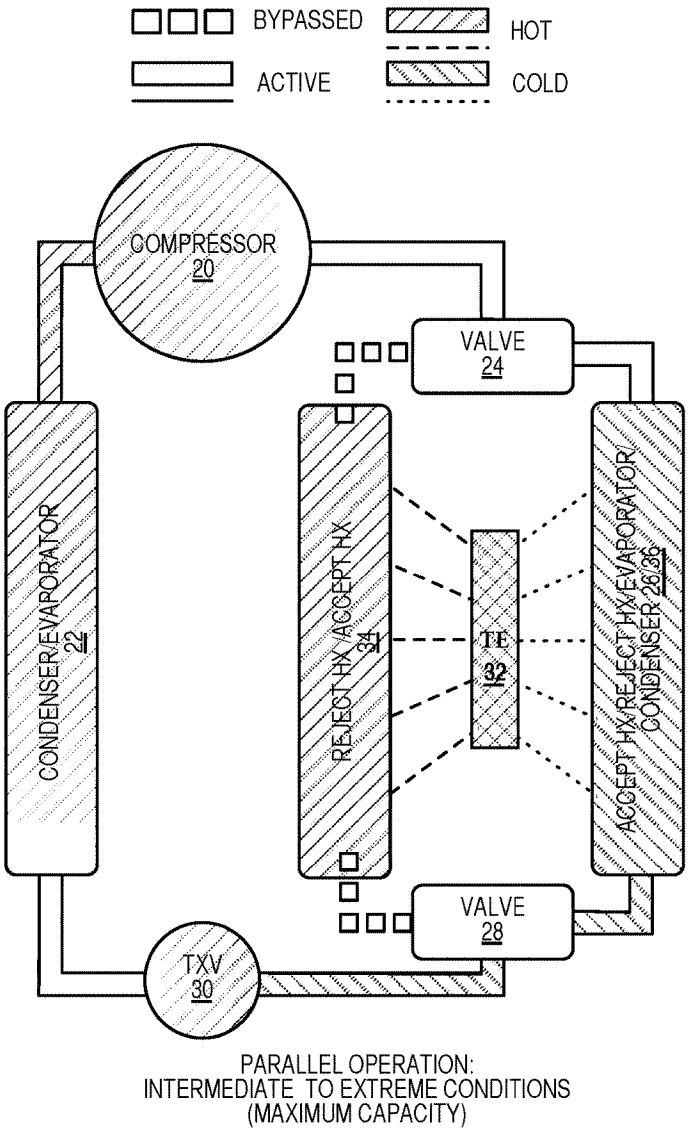
FIG. 5 illustrates a parallel mode of operation of the hybrid VC and TE heat transport system, according to some embodiments of the present disclosure.

While the series mode of operation discussed in FIG. 4 allows for a greater temperature differential and potentially less powerful systems, on some occasions, the total amount of heat transfer is most important. FIG. 5 illustrates a parallel mode of operation of the hybrid VC and TE heat transport system 10, according to some embodiments of the present disclosure. In this embodiment, the first valve 24 is operated to connect the second port of the compressor 20 to the evaporator-condenser 26 of the VC system 12 where the evaporator-condenser 26 is a second heat exchanger 36 of the TE system 14. The second valve 28 is operated to connect the evaporator-condenser 26 to the thermal expansion valve 30. This permits the fluid of the VC system 12 to flow through the evaporator-condenser 26. In this embodiment, the VC system 12 is activated and the TE system 14 is activated.

As shown in FIG. 5, the condenser-evaporator 22 is dissipating heat, acting as a condenser, while the heat is being removed from the evaporator-condenser 26, acting as an evaporator. In this example, the evaporator-condenser 26 is cooled. Simultaneously, the activated TE modules 32 dissipate heat into the first heat exchanger 34 and remove heat from the second heat exchanger 36, cooling it. In this way, both systems are removing heat from the same area. Therefore, a larger overall heat removal can be achieved than when either system is operated alone. For instance, if the VC system 12 is capable of moving $Q_{VC}$ heat from the evaporator-condenser 26, while the TE system 14 removes $Q_{TE}$ heat from the second heat exchanger 36, which is the same as the evaporator-condenser 26, the overall heat removed is $Q_{TOTAL}=Q_{VC}+Q_{TE}$. In some embodiments, this mode of operation can permit either one or both of the VC system 12 and the TE system 14 to be less powerful than either system would be required to be alone to achieve the same overall heat removed.

In some embodiments, operating the hybrid VC and TE heat transport system 10 to maintain the set point temperature range of the chamber 16 includes determining, based on one or more parameters, in which mode to operate the hybrid VC and TE heat transport system 10. In some embodiments, those modes can be chosen from: the VC-only mode of operation, the TE-only mode of operation, the series mode of operation, and the parallel mode of operation. In some embodiments, the VC-only mode is used for an intermediate to high load and/or a high temperature difference. The TE-only mode is used for a low load, a low temperature difference, and/or to augment a primary Heating, Ventilation and Air Conditioning (HVAC) system. The series mode is used for a light to intermediate load and/or a high temperature difference. The parallel mode is used for a high to maximum load and/or a low to medium temperature difference. These are only exemplary conditions for each of the modes of operation and the current disclosure is not limited thereto. Additionally, calculations regarding which mode will optimize various conditions can be taken into account. For instance, efficiency may be optimized, or the overall noise may be reduced.

Figure 6:
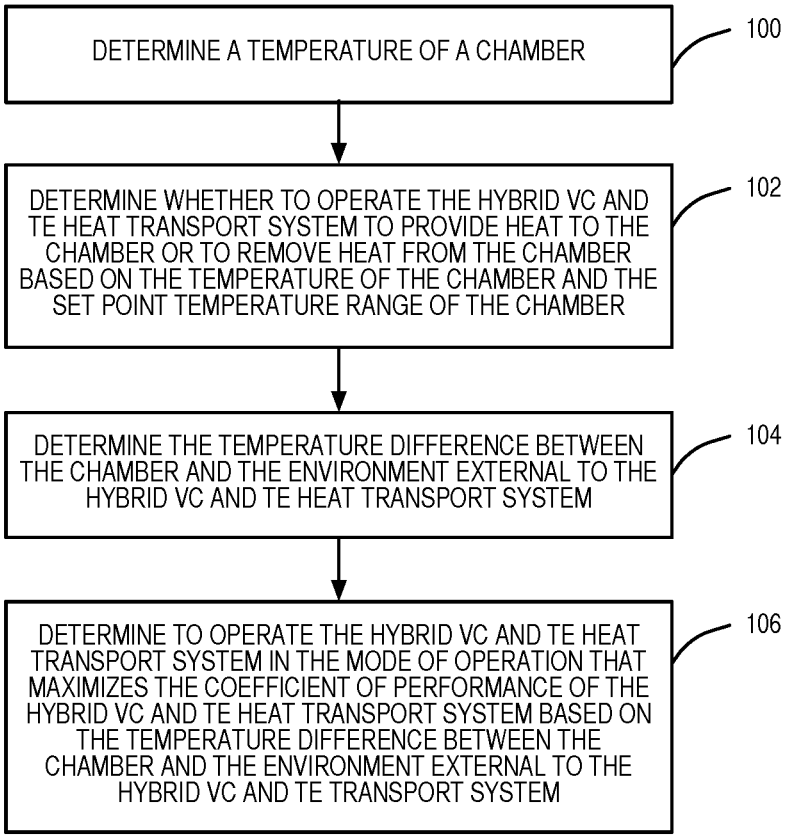
FIG. 6 illustrates a method of controlling the hybrid VC and TE heat transport system, according to some embodiments of the present disclosure.

The decision for which mode of operation to use may be made manually or by a controller 18 as disclosed in FIG. 1. As such, FIG. 6 illustrates a method of controlling the VC and TE heat transport system 10, according to some embodiments of the present disclosure. First, the controller 18 determines a temperature of the chamber 16 (step 100). This may be accomplished with any suitable type of sensor or obtained from some other source.

The controller 18 determines whether to operate the hybrid VC and TE heat transport system 10 to provide heat to the chamber 16 or to remove heat from the chamber 16 based on the temperature of the chamber 16 and the set point temperature range of the chamber 16 (step 102). For instance, if the temperature of the chamber 16 is below the set point temperature range of the chamber 16, the hybrid VC and TE heat transport system 10 may be operated to provide heat to the chamber 16. If the temperature of the chamber 16 is above the set point temperature range of the chamber 16, the hybrid VC and TE heat transport system 10 may be operated to remove heat from the chamber 16. Depending on implementation and application, the set point temperature range may be a single temperature value. However, to prevent rapid switching between a heat and cool mode or a rapid change between off and on, some hysteresis should be applied.

FIG. 6 also illustrates that the controller 18 determines the temperature difference between the chamber 16 and the environment external to the hybrid VC and TE heat transport system 10 (step 104) and determines in which mode of operation maximizes the coefficient of performance of the hybrid VC and TE heat transport system 10 based on the temperature difference between the chamber 16 and the environment external to the hybrid VC and TE heat transport system 10 (step 106). The coefficient of performance of the hybrid VC and TE heat transport system 10, for example, is a measure of the efficiency of the hybrid VC and TE heat transport system 10, and is defined as: $COP=Q_C/P_{in}$, where $Q_C$ is heat transferred by the hybrid VC and TE heat transport system 10 and $P_{in}$ is the input power to the hybrid VC and TE heat transport system 10. In scenarios where both the VC system 12 and the TE system 14 are operating, the $Q_C$ is the combined heat transferred by both systems and the $P_{in}$ is the combined input power to both systems. In some embodiments, additional or different parameters may be used to determine the mode of operation. Additionally, individual parameters of the operation of the hybrid VC and TE heat transport system 10 may also be tuned. Some examples include proving an amount of power to the TE modules 32 to maximize a coefficient of performance of the hybrid VC and TE heat transport system 10 or operating an optional fan to facilitate heat transport.

Figure 7:
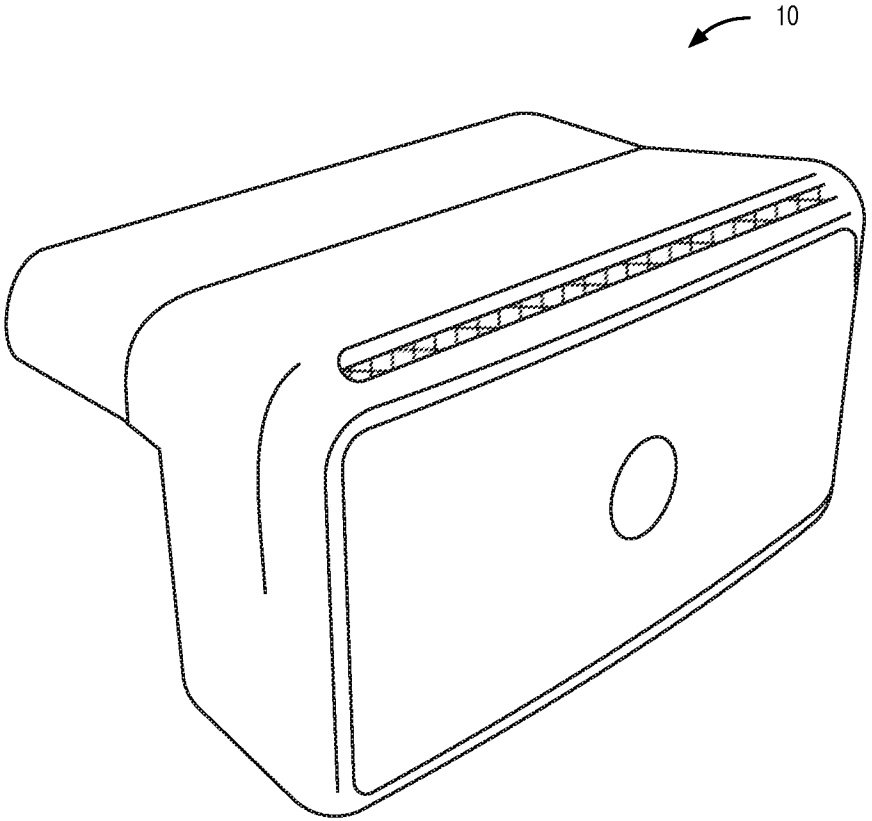
FIG. 7 illustrates a hybrid VC and TE heat transport system, according to some embodiments of the present disclosure.

While a VC and TE heat transport system 10 could be implemented in many ways or configurations, FIG. 7 illustrates a hybrid VC and TE heat transport system 10, according to some embodiments of the present disclosure. Notably, this is merely one example implementation and the current disclosure is not limited thereto. FIG. 7 illustrates an example window unit where the VC system 12 could be less powerful than an equivalent window unit that only has a VC cooling system. Since the VC system 12 could be less powerful, the overall efficiency of the system is increased while reducing the weight and noise of the system. For instance, when the VC system 12 is not operating, the overall system may be very quiet since the TE system 14 may be silent or nearly silent. If a fan is used to distribute the conditioned air, that may be the only sound the unit makes. Additionally, even when the VC system 12 is operating, the ability to use a smaller compressor than for an equivalent all-VC system can lead to less noise generation overall. Additional benefits may be realized by reducing the cost of VC components due to the reduction in power needed.

In other embodiments, the window unit shown in FIG. 7 may only provide the TE system 14 which works cooperatively with a VC system 12 in a primary HVAC system. In this case, the hybrid VC and TE heat transport system 10 can operate in various modes to condition the air in the chamber 16. For instance, the TE-only mode of operation may be used by switching off the VC system 12 in the primary HVAC system and only operating the TE system 14 in the window unit. This might provide increased efficiencies if the temperature differences are small and there is no need to heat or cool the areas served by the primary HVAC system other than the chamber 16.

In other embodiments, the parallel mode of operation might allow the hybrid VC and TE heat transport system 10 to transport more heat to or from the chamber 16 than is needed for the remainder of the areas served by the primary HVAC system.

Those skilled in the art will recognize improvements and modifications to the preferred embodiments of the present disclosure. All such improvements and modifications are considered within the scope of the concepts disclosed herein and the claims that follow.

What is claimed is:

1. A hybrid Vapor Compression (VC) and Thermoelectric (TE) heat transport system arranged to maintain a set point temperature range of a chamber, the hybrid VC and TE heat transport system comprising:

a compressor comprising a first port and a second port;

a first heat exchanger connected to the compressor at the first port;

a first valve connecting the second port to a second heat exchanger and a third heat exchanger;

a second valve connecting the second heat exchanger and third heat exchanger to a thermal expansion valve wherein the thermal expansion valve connects the second valve to the first heat exchanger;

one or more TE modules comprising a first side of the one or more TE modules and a second side of the one or more TE modules;

the second heat exchanger thermally connected with the first side of the one or more TE modules where the second heat exchanger connects the first valve and the second valve;

the third heat exchanger thermally connected with the second side of the one or more TE modules where the third heat exchanger connects the first valve and the second valve; and wherein the hybrid VC and TE heat transport system operates to heat the chamber;

a controller arranged to operate the hybrid VC and TE heat transport system in one of a plurality of modes of operation based on one or more system parameters;

wherein one of the plurality of modes of operation is a VC-only mode of operation and the controller is further arranged to, during the VC-only mode of operation: control the first valve to connect the second port of the compressor to the second heat exchanger; control the second valve to connect the second heat exchanger to the thermal expansion valve; activate the compressor; and refrain from activating the TE modules; and wherein one of the plurality of modes of operation is a TE-only mode of operation and the controller is further arranged to, during the TE-only mode of operation: control the first valve to disconnect the second port of the compressor from the second heat exchanger; control the second valve to disconnect the second heat exchanger from the thermal expansion valve; activate the TE modules; and refrain from activating the compressor.

2. The hybrid VC and TE heat transport system of claim 1 wherein one of the plurality of modes of operation is a series mode of operation and the controller is further arranged to, during the series mode of operation:

control the first valve to connect the second port of the compressor to the second heat exchanger;

control the second valve to connect the second heat exchanger to the thermal expansion valve;

activate the TE modules; and activate the compressor.

3. The hybrid VC and TE heat transport system of claim 2 wherein one of the plurality of modes of operation is a parallel mode of operation and the controller is further arranged to, during the parallel mode of operation:

control the first valve to connect the second port of the compressor to the second heat exchanger;

control the second valve to connect the second heat exchanger to the thermal expansion valve;

activate the TE modules; and activate the compressor.

* * * * *